US008851792B1

(12) United States Patent
Schlenker et al.

(10) Patent No.: US 8,851,792 B1
(45) Date of Patent: Oct. 7, 2014

(54) ROTARY MIXER AND METHOD FOR CONTROLLING MATERIAL GRADATION THEREOF

(71) Applicants: Brian J. Schlenker, Plymouth, MN (US); Brent P. Bachmeier, Prior Lake, MN (US); Jason W. Muir, Andover, MN (US); Mario J. Souraty, Plymouth, MN (US); Maria L. Biberdorf, Maple Grove, MN (US)

(72) Inventors: Brian J. Schlenker, Plymouth, MN (US); Brent P. Bachmeier, Prior Lake, MN (US); Jason W. Muir, Andover, MN (US); Mario J. Souraty, Plymouth, MN (US); Maria L. Biberdorf, Maple Grove, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 0 days.

(21) Appl. No.: 14/250,759

(22) Filed: Apr. 11, 2014

Related U.S. Application Data

(62) Division of application No. 13/832,662, filed on Mar. 15, 2013, now Pat. No. 8,794,869.

(60) Provisional application No. 61/640,386, filed on Apr. 30, 2012.

(51) Int. Cl.

| | |
|---|---|
| ***E01C 19/05*** | (2006.01) |
| ***E01C 19/00*** | (2006.01) |
| ***E01C 23/088*** | (2006.01) |
| ***E01C 21/00*** | (2006.01) |

(52) U.S. Cl.
CPC ..... *E01C 19/00* (2013.01); *E01C 23/088* (2013.01); *E01C 21/00* (2013.01)
USPC ..... 404/84.1; 404/72; 404/75; 404/84.05; 404/84.2; 404/84.5; 404/92; 404/93; 404/94

(58) Field of Classification Search
CPC ..... E01C 19/05; E01C 21/00; E01C 23/088
USPC ..... 404/72, 75, 84.05–84.5, 92–94
See application file for complete search history.

(56) References Cited

U.S. PATENT DOCUMENTS

| | | | | |
|---|---|---|---|---|
| 4,637,753 | A | 1/1987 | Swisher, Jr. | |
| 5,190,398 | A | 3/1993 | Swisher, Jr. | |
| 6,318,649 | B1 | 11/2001 | Mazurkiewicz | |
| 8,006,925 | B2 * | 8/2011 | Liu | 241/23 |
| 2009/0010713 | A1 | 1/2009 | Kotting et al. | |
| 2010/0014917 | A1 | 1/2010 | Willis et al. | |
| 2012/0301220 | A1 | 11/2012 | Snoeck et al. | |

* cited by examiner

*Primary Examiner* — Raymond W Addie
(74) *Attorney, Agent, or Firm* — Joseph E. Reed

(57) ABSTRACT

A rotary mixer herein includes: a rotor chamber configured to receive a first surface and produce a reclaimed surface, the rotor chamber including: a front door, a rear door, and a rotor; a particle size detector configured to detect a particle size of the reclaimed surface; and an electronic control module (ECM) electronically coupled to the rotor chamber and the particle sensor, the ECM configured to: receive a particle size from the particle sensor, compare the detected particle size to a desired particle size, adjust the degree of pulverization of the reclaimed surface according to the difference between the detected particle size and the desired particle size.

8 Claims, 3 Drawing Sheets

ROTARY MIXER AND METHOD FOR CONTROLLING MATERIAL GRADATION THEREOF

CLAIM FOR PRIORITY

The present application claims the benefit of U.S. Provisional Application Ser. No. 61/640,386, filed Apr. 30, 2012 and is a divisional of U.S. application Ser. No. 13/832,662, filed Mar. 15, 2013, all of which are fully incorporated herein by reference.

TECHNICAL FIELD

Embodiments of the present disclosure pertain to a rotary mixer and more particularly to a system and method for material gradation control.

BACKGROUND

A rotary mixer may be used as a soil stabilizer to cut, mix, and pulverize native in-place soils with additives or aggregates to modify and stabilize the soil for a strong base.

A rotary mixer may also be used as a road reclaimer to pulverize a surface layer, such as asphalt, and can mix it with an underlying base to create a new road surface and stabilize deteriorated roadways. Optionally, a rotary mixer can optionally add asphalt emulsions or other binding agents to create a new road surface during pulverization or during a separate mix pass.

In a conventional rotary mixer, an operator may visually inspect the milled (or reclaimed) surface and manually adjust the speed of the rotor, and/or the front and rear chamber doors to adjust the degree of pulverization of the milled surface.

U.S. Pat. No. 5,190,398 issued to Swisher, Jr. on Mar. 2, 1993, discloses an apparatus for pulverizing a surface such as a road and a system for adding liquid to the surface being pulverized.

SUMMARY

According to aspects disclosed herein, a rotary mixer and a control method are provided to regulate a material gradation of a milled material.

According to an embodiment herein, a rotary mixer includes: a rotor chamber configured to receive a first surface and produce a reclaimed surface, the rotor chamber including: a front door, a rear door, and a rotor; a particle size detector configured to detect a particle size of the reclaimed surface; and an electronic control module (ECM) electronically coupled to the rotor chamber and the particle sensor, the ECM configured to: receive a particle size from the particle sensor, compare the detected particle size to a desired particle size, adjust the degree of pulverization of the reclaimed surface according to the difference between the detected particle size and the desired particle size.

The rotor chamber may further include a breaker bar, and the ECM may be configured to adjust the degree of pulverization of the reclaimed surface by adjusting at least one of the rotary speed of the rotor, the position of the front door, the position of the rear door, and the position of a breaker bar according to the difference between the detected particle size and the desired particle size.

According to another embodiment herein, a method for controlling material gradation in a rotary mixer including: detecting a particle size of a milled surface, comparing the detected particle size to a desired particle size on an electronic control module (ECM), and automatically adjusting the degree of pulverization according to the difference between the detected particle size and the desired particle size.

The automatically adjusting the degree of pulverization may include at least one of: adjusting the position of a front door of a rotor chamber, adjusting the position of a rear door of a rotor chamber, adjusting the speed of the rotor, and adjusting the position of a breaker bar.

DETAILED DESCRIPTION

Exemplary embodiments of the present invention are presented herein with reference to the accompanying drawings. Herein, like numerals designate like parts throughout.

Figure 1:
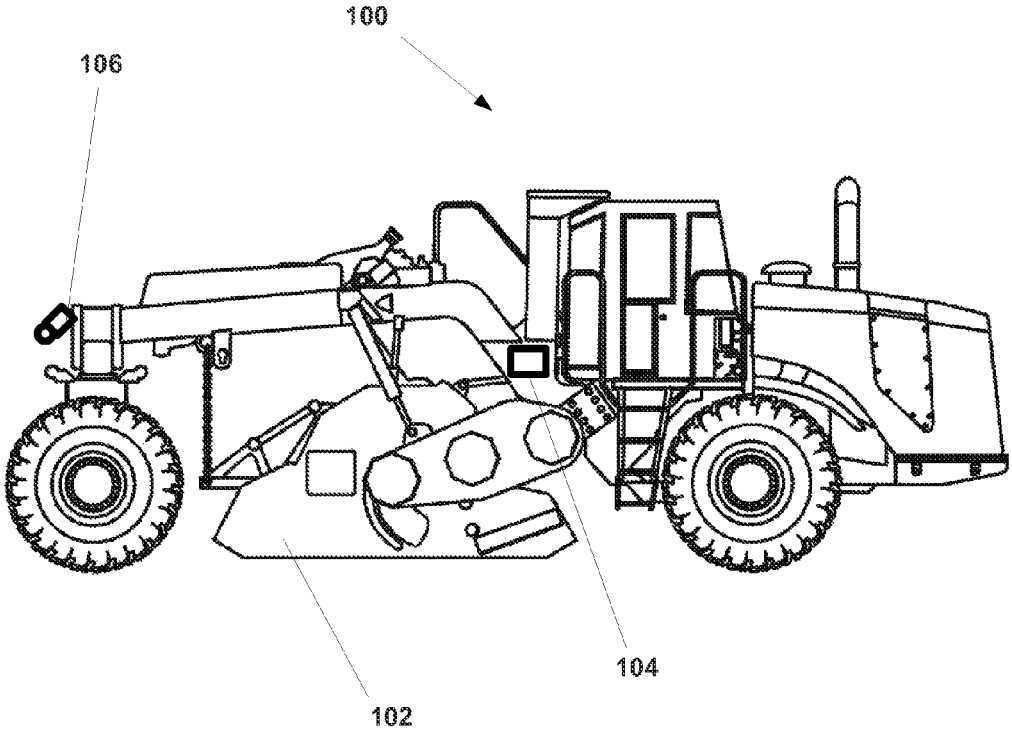
FIG. 1 illustrates an exemplary machine according to an embodiment described herein.
Figure 2:
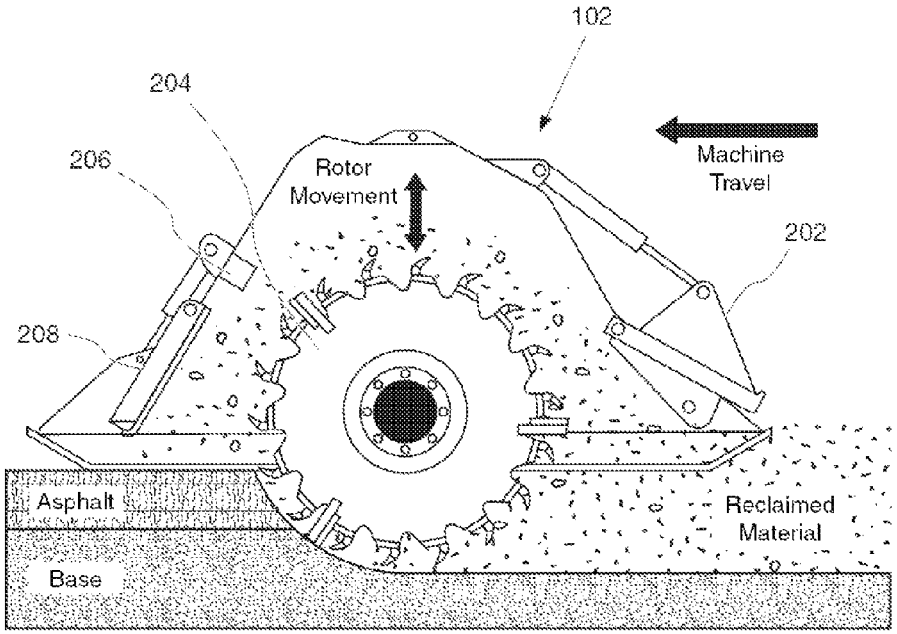
FIG. 2 illustrates a rotor chamber of an exemplary machine according to an embodiment as shown in FIG. 1.

FIGS. 1 and 2 illustrate an exemplary machine 100 (e.g., a rotary mixer 100) according to an embodiment described herein. According to FIGS. 1 and 2 a rotary mixer 100 includes a rotor chamber 102, an electronic control module (ECM) 104, and a particle size detector 106.

The rotor chamber 102 includes a rear door 202, a rotor 204 (also referred to as a milling rotor 204), and a front door 208. Optionally, the rotor chamber 102 may also include a breaker bar 206 to assist in pulverizing a milled surface. According to an embodiment the breaker bar 206 may include a position adjustment device (e.g., hydraulic actuators) configured to adjust the location of the breaker bar 206.

The position of the rear door 202, the front door 208, and the speed of the rotor affects the degree of pulverization by regulating the amount, direction, and speed of material flow through the rotor chamber 102. The position, location, and/or movement of the breaker bar 206 also impacts the degree of particle pulverization.

The ECM 104 may be implemented in hardware (e.g., a controller or processor) or in software, and is configured to control various elements of the pulverization process. For example, the ECM 104 may be configured to adjust the position of the front door 208, the position of the rear door 202, and/or the speed of the milling rotor 204. Additionally, the ECM 104, may also be configured to communicate with the position adjustment device to adjust the position, location, and/or movement of the breaker bar 206.

The ECM 104 may also be configured to store a desired particle size value (e.g., a predetermined desired particle size), and may compare the stored desired particle size value to that of a detected particle size.

The particle size detector 106 may be sensor (e.g., a sonic sensor, laser sensor, camera sensor, etc.) which is configured to determine the size of the particles of the milled surface. The particle size detector 106 is also configured to electronically communicate with the ECM 104 and transmit the detected particle size information.

The particle size detector 106 may be mounted to a surface of the rotary mixer 100 and positioned to detect the size of particles of a reclaimed surface as shown in FIG. 1. Optionally, the particle size detector 106 may be mounted to the outside or within the rotor chamber 102. According to another embodiment, the particle size detector 106 may also be remote sensor (e.g., a hand-held sensor carried by an operator). Additionally, the particle size detector 106 may be multiple sensors or an array of sensors, configured to measure particle sizes at multiple locations.

Figure 3:
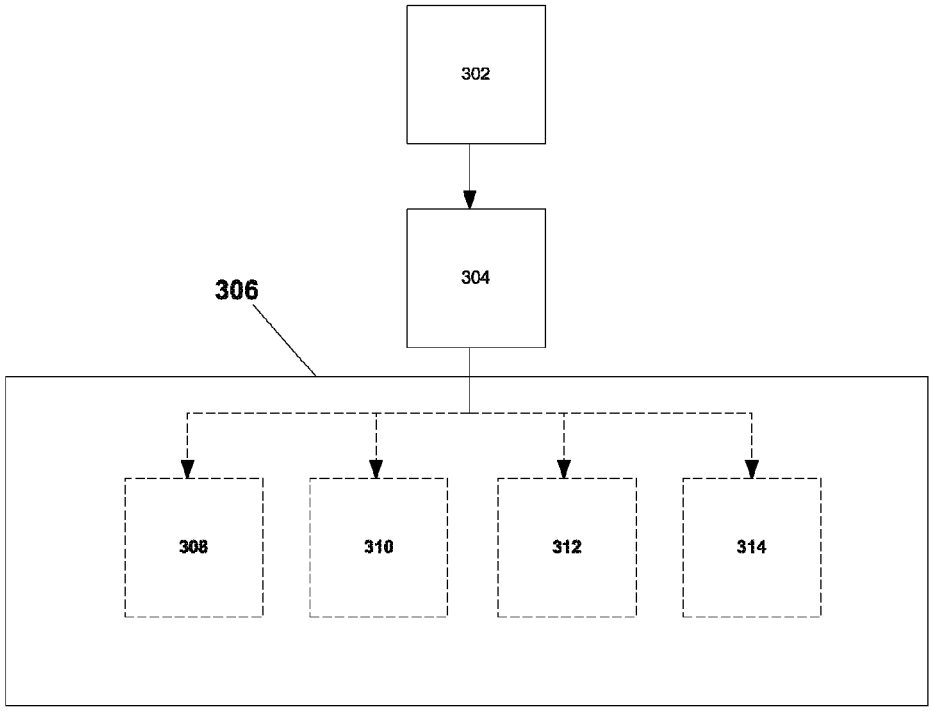
FIG. 3 is a block diagram of a method for controlling material gradation.

FIG. 3 is a block diagram of a method for controlling material gradation. With reference to FIG. 1 and FIG. 2, a method for controlling a machine 100 includes: detecting a particle size of a milled (e.g., reclaimed) surface step 302, comparing the detected particle size to a desired particle size (e.g., a predetermined particle size) step 304, and adjusting the degree of pulverization of the milled surface step 306, according to the difference between the detected particle size and the desired particle size determined in step 304.

The adjusting the degree of pulverization of the milled surface step 306, may include one or more of the steps 308-314: adjusting the position of a front door 208 of the rotor chamber step 308, adjusting the position of a rear door 202 of the rotor chamber step 310, adjusting the speed of the rotor step 312, and adjusting the position of a breaker bar 206 within the rotor chamber step 314.

INDUSTRIAL APPLICABILITY

A machine 100 and control method as described herein may be implemented in various machines. According to one embodiment, the machine 100 and control method may be implemented in a rotary mixer 100 (e.g., a reclaimer 100 or a soil stabilizer 100). For illustration purposes, the following is described with respect to a reclaimer 100, but is not limited thereto.

The reclaimer 100 includes a rotor chamber 102, an ECM 104, and a particle size detector 106 (e.g., a sonic sensor 106). The rotor chamber 102 includes, a rear door 202 (e.g., an adjustable rear door 202), a rotor 204, a breaker bar 206, and a front door 208 (e.g., an adjustable front door 208).

The sonic sensor 106 may, for instance, be mounted to the rotor chamber 102, the rear of the reclaimer 100, or may be a stand-alone (e.g., hand-held) unit. The sonic sensor 106 is configured to be in electrical communication with the ECM 104.

As the reclaimer 100 travels along a surface to be reclaimed (e.g., asphalt), the rotor chamber 102 receives asphalt and a base layer beneath the asphalt. The rotor 204 tears up the asphalt and base layer, combines the two layers together within the rotor chamber 102, and releases a reclaimed layer. Within the rotor chamber 102 the asphalt and base layer is pulverized by the rotor 204 and by the interior of the chamber (including the doors 202 and 208 and breaker bar 206).

After the reclaimed layer is released from the rotor chamber 102, the sonic sensor 106 detects the size of the pulverized particles of the reclaimed layer, and transmits the size to the ECM 104. The ECM 104 compares the detected size against a desired particle size (e.g., a previously stored desired particle size). If the detected particle size is not approximately equal to the desired particle size the ECM 104 transmits a signal to the rotor chamber 102 to change the pulverization level. The ECM 104 may adjust the position of the rear door 202, and/or may adjust the position of the front door 208, and/or may adjust the speed of the rotor 204, and/or may adjust the position of the breaker bar 206. For example, if the particle size detected is too large, the ECM 104 may signal the rotor 204 to increase rotational speed, and/or the ECM 104 may signal the front door 208 and/or rear door 202 to close. The ECM 104 may also signal the breaker bar 206 to extrude further into the rotor chamber 102.

Conversely, if the detected particle size is less than the desired particle size the ECM 104 may transmits a signals to decrease the rotor's 204 rotational speed, and/or the ECM 104 may signal the front door 208 and/or rear door 202 to open. The ECM 104 may also signal the breaker bar 206 to retract within the rotor chamber 102.

The reclaimer 100, e.g., via the sensor may continually monitor the reclaimed particle size, and the ECM 104 may continuously adjust the position of the rear door 202, the front door 208, the breaker bar 206, and/or the speed of the rotor 204, according to the difference between the detected and desired particle sizes.

Although certain embodiments have been illustrated and described herein for purposes of description, it will be appreciated by those of ordinary skill in the art that a wide variety of alternate and/or equivalent embodiments or implementations calculated to achieve the same purposes may be substituted for the embodiments shown and described without departing from the scope of the present disclosure. Those with skill in the art will readily appreciate that embodiments in accordance with the present invention may be implemented in a very wide variety of ways. This application is intended to cover any adaptations or variations of the embodiments discussed herein. Therefore, it is intended that embodiments in accordance with the present invention be limited only by the claims and the equivalents thereof.

What is claimed is:

1. A method for controlling material gradation in a rotary mixer comprising:

milling a paved surface, thereby creating milled particles within the rotary mixer;

detecting a particle size of a milled particle;

comparing the detected particle size to a desired particle size on an electronic control module (ECM); and automatically adjusting a degree of pulverization according to the difference between the detected particle size and the desired particle size.

2. The method of claim 1, wherein the automatically adjusting the degree of pulverization comprises adjusting the position of a front door of a rotor chamber.

3. The method of claim 1, wherein the automatically adjusting the degree of pulverization comprises adjusting the position of a rear door of a rotor chamber.

4. The method of claim 1, wherein the automatically adjusting the degree of pulverization comprises adjusting the rotary speed of a rotor of the rotary mixer.

5. The method of claim 1, wherein the automatically adjusting the degree of pulverization comprises:

adjusting the position of a front door of a rotor chamber of the rotary mixer;

adjusting the position of a rear door of the rotor chamber of the rotary mixer; and adjusting the rotary speed of a rotor of the rotary mixer.

6. The method of claim 1, wherein the automatically adjusting the degree of pulverization comprises adjusting the position of a breaker bar.

7. The method of claim 1, wherein the automatically adjusting the degree of pulverization comprises:

adjusting the position of a front door of a rotor chamber of the rotary mixer;

adjusting the position of a rear door of the rotor chamber of the rotary mixer;

adjusting the rotary speed of a rotor of the rotary mixer; and adjusting the position of a breaker bar.

8. A method for controlling gradation in a rotary mixer comprising:

Milling a paved surface, creating milled particles along a milling path; wherein the detecting the particle size of the milled particle includes measuring the particle size of the milled particle on a sensor remote from the rotary mixer and wirelessly transmitting the detected particle size to the ECM.

* * * * *